United States Patent [19]

Rodenbaugh et al.

[11] 4,373,437

[45] Feb. 15, 1983

[54] APPARATUS TO SUPPLY ARTICLES FOR PRINTING

[75] Inventors: Ralph L. Rodenbaugh, Pittsburgh; John M. Zwigert, Cabot, both of Pa.

[73] Assignees: Deco Coatings Corporation, Pittsburgh; Carl Strutz & Company, Inc., Mars, both of Pa.

[21] Appl. No.: 218,417

[22] Filed: Dec. 19, 1980

[51] Int. Cl.[3] ..... B41F 17/00

[52] U.S. Cl. ..... 101/35; 198/443; 198/482; 198/796

[58] Field of Search ..... 101/35, 38 A, 40, 36, 101/37, 44; 198/443, 476, 482, 796, 654, 391, 757, 399

[56] References Cited

U.S. PATENT DOCUMENTS

| | | | |
|---|---|---|---|
| 1,339,881 | 5/1920 | De Barros | 101/44 |
| 1,370,851 | 3/1921 | Sligh | 101/44 X |
| 1,656,494 | 1/1928 | Nutt et al. | 101/38 A |
| 2,109,360 | 2/1938 | Shurley | 101/38 A |
| 2,409,368 | 10/1946 | Lipton | 101/38 A X |
| 2,547,602 | 4/1951 | Schmitt | 101/44 |
| 2,778,298 | 1/1957 | Russey | 101/44 |
| 2,859,689 | 11/1958 | Ackley | 101/35 |
| 2,939,387 | 6/1960 | Guerchet | 101/40 |
| 3,231,061 | 1/1966 | Borkmann | 198/482 X |
| 3,244,276 | 4/1966 | Johnson, Jr. et al. | 101/35 X |
| 3,250,212 | 5/1966 | Uschmann | 101/40 |
| 3,267,842 | 8/1966 | Resnick et al. | 101/40 |
| 3,282,202 | 11/1966 | Groth et al. | 101/37 |
| 3,543,681 | 12/1970 | Klenz | 101/44 |
| 3,917,055 | 11/1975 | VandenBerg et al. | 198/399 X |

FOREIGN PATENT DOCUMENTS

| | | | |
|---|---|---|---|
| 1048930 | 1/1959 | Fed. Rep. of Germany | 101/44 |

*Primary Examiner*—Edgar S. Burr
*Assistant Examiner*—Moshe I. Cohen
*Attorney, Agent, or Firm*—Thomas H. Murray; Clifford A. Poff

[57] ABSTRACT

Carrier attachments on a roller chain receive a bottle cap for printing at a loading station formed at the discharge end of a downwardly-inclined chute. A top constrainment member is normally spaced from the top of the carrier attachments at the loading station by a distance less than the height of the bottle caps in the supply chute to prevent advancement of the caps until an underlying carrier attachment advances beyond the bottom support surface of the cap. The constraining member is resilient to urge the article into the space between the attachments according to one embodiment or according to a second embodiment, the article drops onto a carrier. The article is supported by surfaces on guide rails during movement to a printing station by the conveyor.

10 Claims, 8 Drawing Figures

10
11
12
13
14
15
16
17
18
19
20
21
22
23
24
25
26
27
28
29
30
31
37
38
54

APPARATUS TO SUPPLY ARTICLES FOR PRINTING

BACKGROUND OF THE INVENTION

The present invention relates to an apparatus to supply articles in succession to a printing station, and more particularly to such an apparatus to provide an orderly conveyance of articles from a chute onto a conveyor for delivery thereby to a printing station.

While not so limited, the present invention is particularly useful for delivering a succession of bottle caps to a printing station where the top face surface of each cap moves into contact with an inked image carried by a transfer roll. In this type of printing process, the bottle caps, typically made of plastic, are supplied and removed from a printing operation in bulk containers. It is necessary, therefore, to orientate the bottle caps so that their surfaces intended for printing are arranged for contact with the ink transfer roll. One form of sorting apparatus is a vibratory container having an open top to receive a supply of bottle caps and an opening in the side wall to discharge an orientated supply of bottle caps. The bottle caps orientated by the sorting apparatus must be moved in a synchronous relation with the peripheral surface speed of the transfer roll. The movement of the caps must be in a timed relation to pass into contact with one or more inked patterns of indicia on the transfer roll to insure transfer of the ink onto each cap at the desired printing site.

Because of the size and weight of the article, a roller-chain type conveyor is suitable to transport articles, such as bottle caps, for contact with an ink transfer roll. However, there remains the problem of loading the articles from the sorting device onto the conveyor. The loading operation must be accurate and effective without stoppages to the flow of articles to the ink transfer roll. A mechanical transfer mechanism might achieve the intended result but is undesirable because mechanical failure and malfunctions inherently occur causing a disruption to the entire printing process. However, the loading operation must accommodate article-pretreating operations for the printing process. Specifically, the surface of a plastic bottle cap to receive liquefied thermoplastic ink is usually flame-treated to enhance transfer of such ink.

SUMMARY OF THE INVENTION

It is an object of the present invention to provide a constraining member at the discharge end of a chute situated at a loading station for a conveyor to prevent advancement of an article until a carrier attachment on a conveyor passes beneath the support surface of the article for passage thereof into the space between carrier attachments.

It is a further object of the present invention to provide apparatus to supply articles in succession to a printing station through the use of a conveyor having carrier attachments at spaced-apart intervals to receive therebetween an article at a loading station where a member prevents advancement of the article under a resilient force until a carrier attachment passes or slides along the bottom support surface of the article so that it can drop onto the conveyor between the attachments.

More particularly, according to the present invention, the apparatus includes a conveyor having spaced-apart attachment members extending from the top of pivotally-joined links engageable with a support for movement from an article-loading station to beyond a printing station, a drive coupled to at least one of two sprockets engaging the links at opposite ends of the conveyor, a supply chute including an article guide extending to the loading station, an article-constraining member extending from the article guide beyond the terminal end thereof at the article-loading station, the constraining member being normally spaced from the top of an attachment member while located at the loading station by a distance less than the height of the articles in the supply chute to prevent advancement of the article until an underlying attachment advances to engage the article whereupon the constraining member permits falling of the article onto the conveyor between attachments, means to deliver articles in succession to the supply chute, and printing means at the printing station operative in a timed relation with movement of the conveyor to print indicia upon the articles while carried by the conveyor.

In such apparatus, the constraining member preferably extends along the loading station by a distance at least equal to the space between two adjacent spaced-apart attachments. The constraining member is preferably resilient and defined by an extended and yieldable top section of the structure forming part of a top article guide. A pressure foot may be attached to the yieldable end section. Irrespective of the form of the top guide, the bottom guide member for the article must terminate at a point such that a fall space exists for passage of an article into the space between attachments on the conveyor chain. The attachments to the conveyor chain are conveniently made from plastic so that they can slide along the bottom surface of a plastic bottle cap without the development of an excessive frictional force due to the force imposed on the bottle cap by contact with the constraining member. However, the attachments to the conveyor chain are made of metal or other heat-resistant material when a flame-treating station is located between the article loading and printing stations.

These features and advantages of the present invention as well as others will be more fully understood when the following description of two embodiments is read in light of the accompanying drawings, in which.

Figures 1, 2:
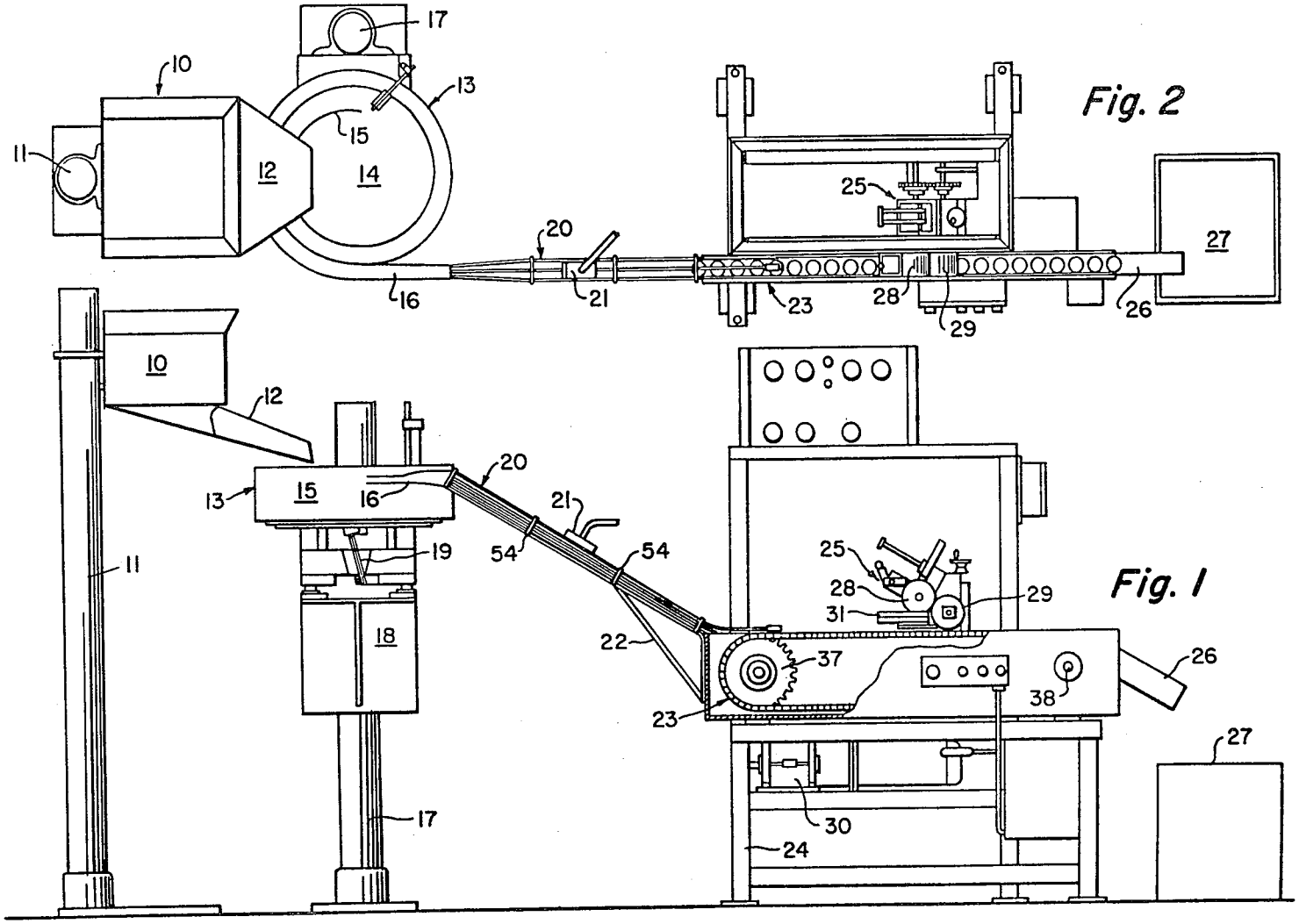
FIG. 1 is a front elevational view of apparatus according to one embodiment of the present invention to supply plastic bottle caps in succession for a printing process.
FIG. 2 is a plan view of the apparatus shown in FIG. 1.

FIGS. 1 and 2 illustrate the general arrangement of parts for supplying articles to a printing apparatus which is designed for printing upon the top surface of plastic bottle caps. This arrangement of parts includes a supply bin 10 carried by a support pedestal 11 such that a discharge chute 12 directs a supply of bottle caps into a vibratory-type separator 13. The separator, *per se,* well known in the art, essentially includes a container having an open top with a floor 14 and a spirally-shaped upstanding side wall 15. The floor 14 progressively increases in height along the spiral shape of wall 15 to an elevation where a separator chute 16 conducts the bottle caps from the separator. A pedestal 17 supports the container and an oscillating drive 18 is coupled to the container by a spring 19. The supply bin 10 is supported above the separator 13 so that the separator chute 16 supplies bottle caps to the entry end of a guide chute 20 downwardly inclined at an acute angle to the horizontal along which there is a burner 21 of a flame-treating device. A bracket 22 supports the lower end of the guide chute upon the end wall of a conveyor 23. The conveyor is supported by a frame 24 that also supports a printing apparatus 25. A discharge chute 26 is used, when desired, to receive bottle caps from the conveyor after printing and direct them into a collector bin 27.

The printing apparatus 25 may be of any well known form and preferably includes two bearing blocks carrying arbors, one of which supports a heated debossed roll 28 and the other arbor supports a heated transfer roll 29 made of elastomer material. The rolls 28 and 29 are synchronously driven by meshing gears on the arbors thereof, one of which additionally carries a sprocket wheel that is connected by a chain to a drive motor 30. Thermoplastic ink is liquefied in a heated container 31. The debossed roller 28 receives a supply of liquefied ink from the container 31. A doctor blade strips excess paint from the roller so that only the debossed surface thereof transports the paint of the elastomer roller 29 which, in turn, carries the paint from the debossed surface to an actual printing site forming a printing station at a point directly overlying a bottle cap carried by the conveyor 23.

Figures 3, 4, 5, 8:
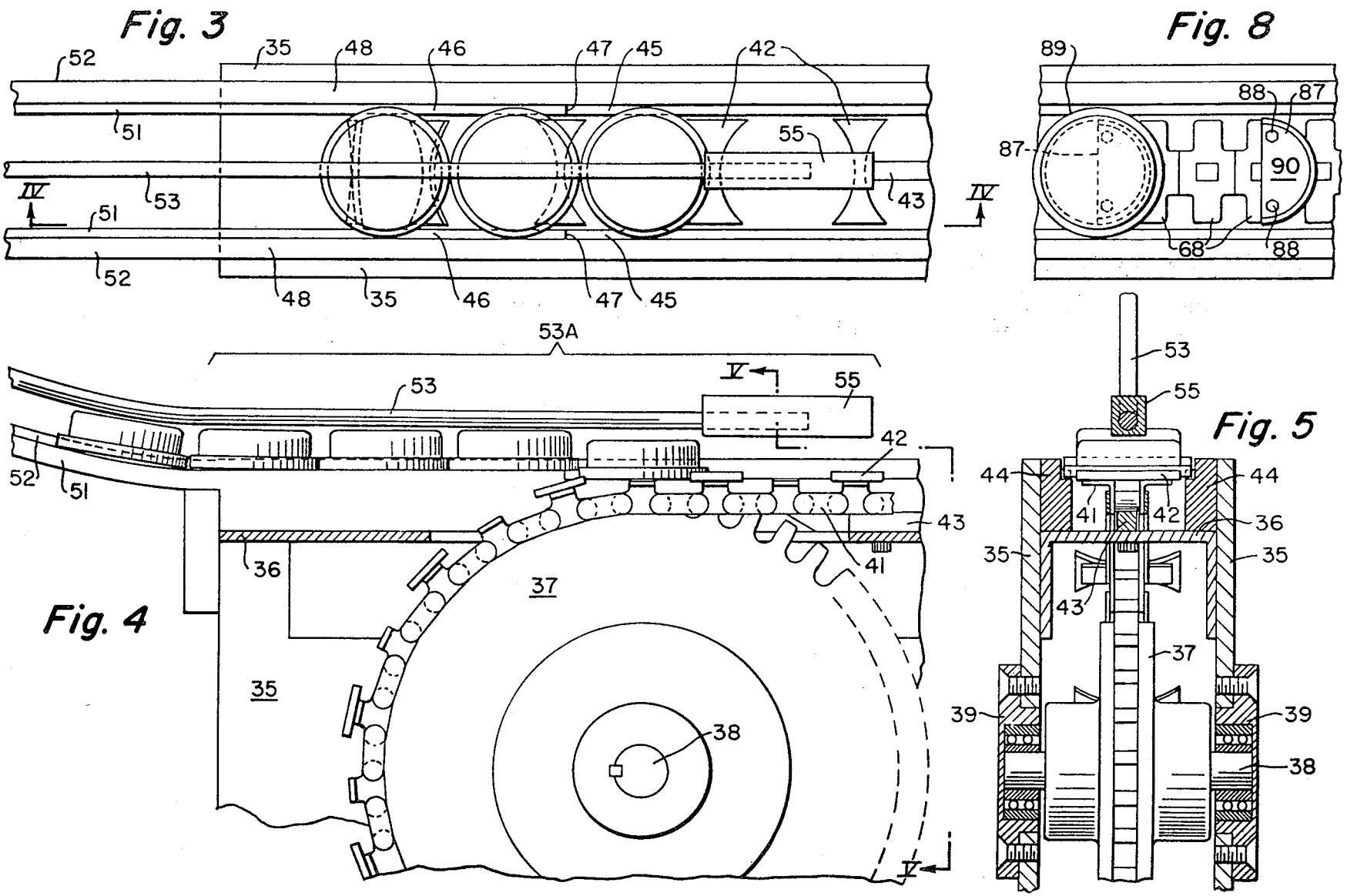
FIG. 3 is an enlarged plan view of an article-loading station for the conveyor of the apparatus shown in FIG. 1.
FIG. 4 is a sectional view taken along line IV—IV of FIG. 3.
FIG. 5 is a sectional view taken along line V—V of FIG. 4.
FIG. 8 is a plan view similar to FIG. 3 but illustrating a further embodiment of a carrier attachment for engaging an article on a conveyor.

As best shown in FIGS. 3–5, the conveyor 23 includes housing plates 35 held in spaced-apart relation by a spreader bar 36. Sprockets 37 are supported between the housing plates at spaced-apart locations on arbors 38 supported by bearings 39 attached to the housing plates. An endless roller chain 41 is trained about the sprockets. Carrier attachments 42 are secured by threaded fasteners to the individual links of the chain at spaced-apart intervals. Each carrier attachment is preferably made from plastic material with curved edge surfaces to form a generally circular space between two of the attachments to engage the side surface of a bottle cap when moved into this circular space. Between the sprockets at the feed run of the chain, there is a support bar 43 to engage with and support the roller surfaces of the chain. A guide bar 44 extends along each housing plate 35 at opposite sides of the conveyor chain. The guide bar 44 defines support surfaces 45 to engage with diametrically-opposite arcuate segments of the bottle caps during propelled movement by the conveyor. At right angles to surface 45 is a restraining surface to prevent excessive lateral movement of the cap. The guide surfaces 45 are generally coplanar with the top surface of the links of the conveyor at the feed run. The entry portion of the feed run includes a loading station wherein transitional movement of the bottle cap occurs from a contained relation within the chute 20 to a positively-driven engagement between the carrier attachments 42 of the conveyor. Within the loading station there are two cap support rails forming support surfaces 46 that are spaced above and generally parallel with the surfaces 45. At the junction between each surface 45 and surface 46, there is a step identified by reference numeral 47 in FIG. 3. Surfaces 46 are formed by rail members 48 that also define side guide surfaces at diametrically-opposite sides of a cap. Rail members 48 may be extensions of guide bars 44 but terminate at the discharge end of chute 20. The guide chute 20 is preferably made up of bottom support bars 51, spaced-apart side bars 52 and a top constrainment bar 53. The bars are held in spaced-apart relation to confine bottle caps for free passage by spanner plates 54 (FIG. 1). The top constrainment bar 53 preferably extends beyond the terminal end of the guide chute in a spaced-apart overlying relation along the loading station. The bars 51, 52 and 53 are preferably made of stainless steel and include a bar extension 53A of bar 53 spaced from the top of a carrier attachment at the loading station by a distance less than the height of the bottle cap to impose a downward force which prevents advancement of a cap until an underlying carrier attachment advances beyond the bottom support surface of the cap. When this occurs, the bar extension 53A provides an effective resilient force to urge the cap into the space between the carrier attachments. The cap moves downwardly at the loading station at a point which is downstream of step surface 47; while upstream of the surface the next succeeding cap is restrained under the resilient force of bar extension 53A. The amount of force imposed on the caps by bar extension 53A is selected so that the force imposed on the caps within the chute due to gravity will advance the caps in succession beyond surface 47. A foot member 55 may, if desired, be attached to the free end of the bar extension 53A.

Figure 6:
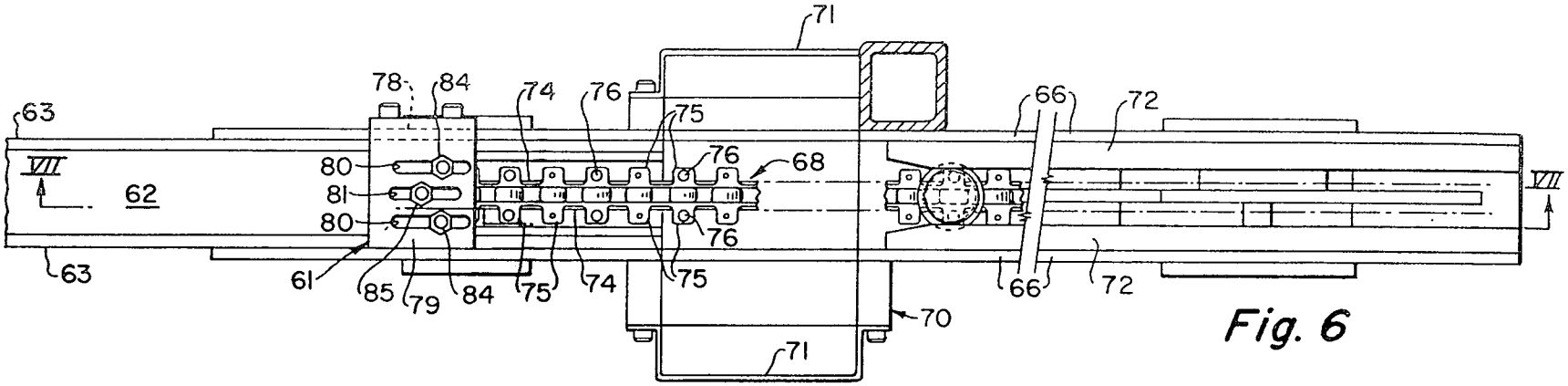
FIG. 6 is a plan view of apparatus according to a second embodiment of the present invention.
Figure 7:
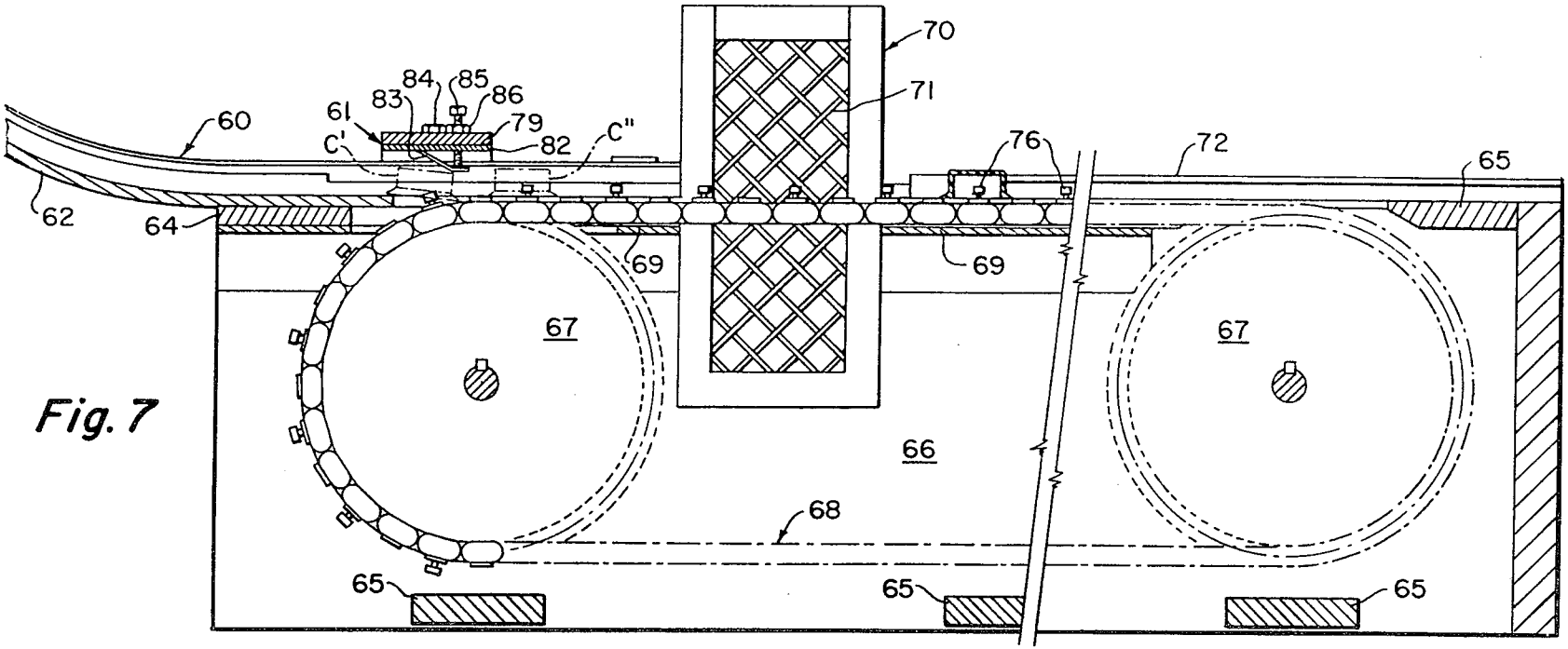
FIG. 7 is a sectional view taken along line VII—VII of FIG. 6.

The embodiment of the present invention illustrated in FIGS. 6 and 7 provides a modified form of attachments to the conveyor, structure to locate the flame-treating apparatus at a preferred location and a further form of structure to constrain articles at the loading station for the conveyor. It is to be understood that the separator 13 described hereinbefore is used to deliver articles in succession to a delivery chute 60 extending to a loading station 61 shown in FIGS. 6 and 7. The delivery chute includes a curved bottom wall 62 that supports upstanding side rails 63 along opposite edges thereof. The chute at its discharge end is supported on a spreader bar 64 used with other spreader bars 65, one of which is located at the discharge end of the conveyor and others below the conveyor to hold housing plates 66 in spaced-apart relation. Sprockets 67 are supported between the housing plates on arbors in the same manner as the sprockets 37 are supported by arbors 38. An endless roller chain 68 is trained about the sprockets with the feed run of the chain moving along support members 69. A safety cage 70 is constructed between the support members 69 at a location which is downstream of the loading station 61. The safety cage 70 includes wire mesh 71 attached to a frame arranged in openings in the housing plates 66 for a burner used to flame-treat the surface of each plastic bottle cap while carried by the conveyor. The burner is, *per se,* well known in the art and supported by a bracket on the safety cage so that the flame from the burner is directed toward the top surface of a bottle cap while carried by the length of conveyor passing through the cage. An L-shaped member 72 at each of the opposite lateral sides of the conveyor chain prevents unwanted lateral movement of the bottle caps while transported to the printing station.

The chain 68 includes side plates 74 with a support plate section 75 projecting laterally from the conveyor chain. The plate section 75 forms a flat article-support surface at each lateral side of alternate links forming the chain. A tapped hole in the plate section 75 receives a carrier member 76 such as a threaded stud or bolt, to project above the links of the chain at the feed run thereof. As the carrier members 76 move about the periphery of the sprockets 67 toward the loading station, they pass into the hollowed-out area of the bottle cap and engage against the inside surface of the side wall thereof. A bottle cap C' is shown in a restrained position at the loading station just prior to the engagement with two carriers, each at an opposite side of the chain. At an advanced position from bottle cap C', a cap member C'' is shown while carried by the engagement with carrier members projecting from links of the chain.

At the loading station 61, a support plate 78 is attached to the outer face surface of one of the housing plates 66. The plate 78 carries, in a cantilever fashion, a support fixture 79 having spaced-apart and parallel slotted holes 80 and a slotted hole 81 therebetween. Each slotted hole 80 receives a threaded fastener 84 to attach a sliding plate 82. Plate 82 carries an L-shaped pressure member 83, preferably made of spring material. The position of the projected terminal end portion of the spring member 83 is adjusted by releasing threaded fasteners 84 and then sliding the carrier plate to a desired site above the conveyor. The fasteners 84 are then tightened. As can be seen in FIG. 7, the projected leg portion of the spring member 83 extends to a spaced-apart relation from the conveyor which is less than the height of a cap member. A stop 85 is provided by installing a threaded bolt into a tapped hole in the plate 82 which aligns with the slotted opening 81. A lock nut 86 on the fastener is used to prevent unwanted rotation of the fastener after it is positioned so that its lower end can contact the spring member when deflected by the passage of a cap member beyond the loading station.

In FIG. 8, carrier attachments 87 are secured by threaded fasteners 88 to individual links of the roller chain 68. Unlike the carrier attachments 42 in FIGS. 3 and 4, each attachment 87 is dimensioned to pass into the hollow interior of a bottle cap which is identified in FIG. 8 by reference numeral 89. Attachment 87 is a semicircular plate with a beveled top leading edge 90 to facilitate loading and unloading of a cap onto the conveyor at opposite ends thereof. At the loading station, the cap drops onto the conveyor as previously described, when an attachment 87 is aligned below the hollow interior of the cap.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. Apparatus to supply articles in succession to a printing station, said apparatus including a conveyor having spaced-apart attachment members extending from the top of pivotally-joined links engageable with a support for movement from an article-loading station to beyond said printing station, a drive coupled to at least one of two sprockets engaging the links at opposite ends of the conveyor, a supply chute inclined at an acute angle to the horizontal and including an article guide extending to said loading station, an article-constraining member with a yieldable end section extending from said article guide beyond the terminal end thereof and over the initial part of said conveyor for restraining an article against advancement from the article-loading station, said yieldable end section being normally spaced from the top of an attachment member while located at the loading station by a distance less than the height of the articles in the supply chute for restraining an article against advancement from the loading station toward the printing station until an underlying attachment advances to engage the article whereupon the yieldable end section permits falling of the article onto the conveyor between attachments for advancement of the article to the printing station, means to deliver a succession of abutting articles to said supply chute, and printing means at said printing station operative in a timed relation with movement of said conveyor to print indicia upon the articles when carried by said conveyor.

2. The apparatus according to claim 1 wherein said constraining member extends along said loading station by a distance at least equal to the space between two adjacent spaced-apart attachment members.

3. The apparatus according to claim 1 wherein said support for the links of the conveyor includes a link support bar extending along a plane from the loading station to beyond the printing station.

4. The apparatus according to claim 1 wherein said article-supply chute extends upwardly from the top of said conveyor to deliver succeeding articles under the force of gravity.

5. The apparatus according to claim 1 wherein said article guide of the supply chute includes a constrainment bar with said yieldable end section defining said article-constraining member.

6. The apparatus according to claim 5 wherein said article-constraining member includes a pressure foot attached to said yieldable end section.

7. The apparatus according to claim 1 further including means to treat the surface of articles while carried by said conveyor from the loading station to the article-printing station.

8. The apparatus according to claim 7 wherein said means to treat includes a burner to direct a gas flame toward the surface of articles.

9. The apparatus according to claim 1 wherein said article-constraining member includes a resilient pressure foot, a stop to limit resilient deflection of said pressure foot in the direction away from said conveyor, and frame means to support said pressure foot and said stop.

10. The apparatus according to claim 9 wherein said article-constraining member further includes means to adjustably position said pressure foot and said stop on said frame means.

* * * * *